US007040784B2

(12) United States Patent
Yen

(10) Patent No.: US 7,040,784 B2
(45) Date of Patent: May 9, 2006

(54) WIRING BOX FOR ARTISTIC LAMP

(75) Inventor: Chason Yen, Taipei (TW)

(73) Assignee: Pascal Products Company Ltd., Taipei (TW)

( * ) Notice: Subject to any disclaimer, the term of this patent is extended or adjusted under 35 U.S.C. 154(b) by 141 days.

(21) Appl. No.: 10/857,014

(22) Filed: Jun. 1, 2004

(65) Prior Publication Data

US 2005/0265034 A1 Dec. 1, 2005

(51) Int. Cl.
*F21S 8/06* (2006.01)

(52) U.S. Cl. ..... 362/405; 362/653; 439/531

(58) Field of Classification Search ..... 362/405, 362/653; 439/531
See application file for complete search history.

(56) References Cited

U.S. PATENT DOCUMENTS 6,517,223 B1 * 2/2003 Hsu ..... 362/405
6,565,240 B1 * 5/2003 Wu ..... 362/405
6,918,686 B1 * 7/2005 Wu ..... 362/459
6,935,765 B1 * 8/2005 Hsu ..... 362/405

* cited by examiner

*Primary Examiner*—Stephen Husar
*Assistant Examiner*—Hargobind S. Sawhney

(57) ABSTRACT

A wiring box for artistic lamp constructed to include a lamp main body and a plurality of plugs, wherein, the lamp main body encompasses a housing, a conducting ring and a plurality of conducting sockets. The present invention is characterized in that each of the conducting sockets is configured with conducting copper strips, and a base of each of the conducting sockets is provided with a fastening portion. The conducting copper strips thereby realize an electrical conductance with the conducting ring. Conducting clips are further configured on each of the plugs, moreover, each of the plugs is provided with a clip fastening structure. The lamp main body and the plugs effectuate rapid connecting and effectiveness of realizing the electrical conductance, and provide a fixtural configuration that will not fall apart while achieving objective of convenient packaging and storage of the artistic lamp.

13 Claims, 13 Drawing Sheets

WIRING BOX FOR ARTISTIC LAMP

BACKGROUND OF THE INVENTION (a) Field of the Invention

The present invention relates to a wiring box for artistic lamp, and more particularly to a configuration structured to embody a lamp main body and a plurality of plugs, wherein the lamp main body encompasses a housing, a conducting ring, and a plurality of conducting sockets. Each of the plugs comprise a conducting sleeve and a connecting sleeve, wherein shape of a frontal end of each of the plugs is so adapted to correspond to that of the conducting sockets for plugging thereinto.

(b) Description of the Prior Art

Majority of artistic lamps designed for usage in a general household, a dining hall, a large banquet hall, and so on, are fitted to a ceiling, as depicted in FIG. 1, which shows an artistic lamp a securely fixed to a ceiling b. Furthermore, a lamp main body al extends from below the ceiling b in order to reinforce a ceiling fitting rod c, and a plurality of ornaments a2 are configured on the lamp main body a1. Light is emitted from light bulbs configured at frontal ends of branch portions a3 extending in various directions from the lamp main body 1; thereby providing the entire artistic lamp a with eye appeal attractiveness. The lamp main body a1 and the branch portions a3 of majority of conventional artistic lamps a are manufactured as an integral body, and after attaching the other ornaments a2 to the lamp main body a1, an enlargement in dimensions to the artistic lamp a results, which causes difficulty in packaging, moreover, when installing or disassembling the artistic lamp a, many persons working together are necessary in order to support the artistic lamp a and carry out fitting of the artistic lamp a to the ceiling b or detaching therefrom, and thus is extremely inconvenient. Hence, in light of the aforementioned shortcomings, the inventor of the present invention designed a configuration that utilizes a fastening portion in a base of each of a plurality of conducting sockets of a lamp main body to mutually integrate with a plug at an extremity of each branch portion provided with a clasp fastening structure, thereby effectively allowing separate packaging of the lamp main body, the ornaments and the branch portions, and thus reducing dimensions of the packaging, while moreover, when installing the artistic lamp, rapid assembly of the lamp main body and the branch portions is realized, while only requiring one person to implement and successfully compete installation, which not only effectuates secure fitting of the artistic lamp to a ceiling, but also rapid installation or disassembling of the artistic lamp is actualized. The artistic lamp of the present invention is thus in accordant with requirements of market needs.

SUMMARY OF THE INVENTION

In light of aforementioned shortcomings in structure of a conventional artistic lamp, the inventor of the present invention, having accumulated years of experience in related arts, attentively and circumspectively carried out extensive study and exploration to ultimately design a completely new wiring box for artistic lamp.

A primary objective of the present invention is to provide the wiring box for artistic lamp that effectuates rapid installation and disassembling, moreover will not come apart from a secure fitting to a ceiling, while achieving effectiveness of convenience when packaging the artistic lamp.

In order to achieve the aforementioned objective, the wiring box for artistic lamp of the present invention is primarily constructed to embrace a lamp main body and a plurality of plugs, wherein, the lamp main body encompasses a housing, a conducting ring and a plurality of conducting sockets. Each of the plugs comprise a conducting sleeve and a connecting sleeve, moreover, shape of a frontal section of each of the plugs is so adapted to correspond to that of the conducting sockets for plugging thereinto. The conducting ring is configured within an inner wall of the housing, and a plurality of oval apertures having same dimensions are defined in a side wall of the conducting ring. Annular grooves are separately defined in an upper edge and a lower edge of the inner wall of the conducting ring respectively. Each of the conducting sockets are assembled to comprise a coupling seat, a fixing piece and conducting copper strips, wherein a long through-hole and a fastening portion are defined interior of the coupling seat. Left and right sides at a rear end of the coupling seat are respectively provided with screw holes and a clamping slot, which are employed to fasten the conducting copper strips to the coupling seat thereof, whereupon a conducting end of each of the conducting copper strips is exposed, and which are respectively inserted into the annular grooves of the conducting ring. Another end of each of the conducting copper strips is provided with a connecting end that extends inwardly from an opening of the coupling seat. Each of the plugs is structured to comprise the conducting sleeve at a frontal section and the connecting sleeve at a rear section. Upon coupling the conducting sleeves and the connecting sleeve, the plug is thereby formed; moreover, conducting clips are separately configured at a frontal end of the plug. A clasp fastening structure is provided on a lower section of an outer side wall of each of the plug, and which is utilized for fastening therewith. After plugging into the conducting socket, the clasp fastening structural fastens onto a fastening portion of the conducting socket, moreover, the conducting clips clip fasten the conducting copper strips of the conducting socket, thereby realizing an electrical conductance thereat.

According to aforementioned structural configuration, when assembling the artistic lamp, the lamp main body is first securely fitted to the ceiling, thereafter power cables are separately connected to the conducting ring configured interior of the lamp main body, and the conducting copper strips of the conducting sockets are separately connected to the conducting ring, thereby enabling the conducting sockets to realize the electrical conductance state. In addition, the connecting sleeve of each of the plugs is directly configured at a tail end of each of the branch portions of the artistic lamp, and the power connecting cables of each of the light bulbs of the artistic lamp are connected to the conducting clips configured interior of the conducting sleeve. Upon assembling the artistic lamp branch portions to the lamp main body, the plugs are directly plugged into connecting sockets configured interior of the lamp main body, thereby enabling the conducting clips of the artistic lamp branch portions to clip fasten the conducting copper strips of the conducting sockets, and thus realize the electrical conductance, whereupon the clip fastening structure at the lower section of the outer side wall of the plug clip fastens and thereby secures fixing in the corresponding fastening portion of the lamp main body, moreover, the clip fastening structure effectuates detachment of the branch portions from a release aperture defined in a base of the housing. Thereafter, the ornaments are fitted to an appropriate position of the lamp man body, thereby forming a split-system artistic lamp, which not only realizes convenience of installation and disassembling, and a fixtural configuration that will not fall apart, but also effectuates separating the artistic lamp for packaging and storage purposes, thereby averting shortcoming of inconvenient storage resulting from dimensions of the artistic lamp being excessive after completing assemblage of the entire artistic lamp.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
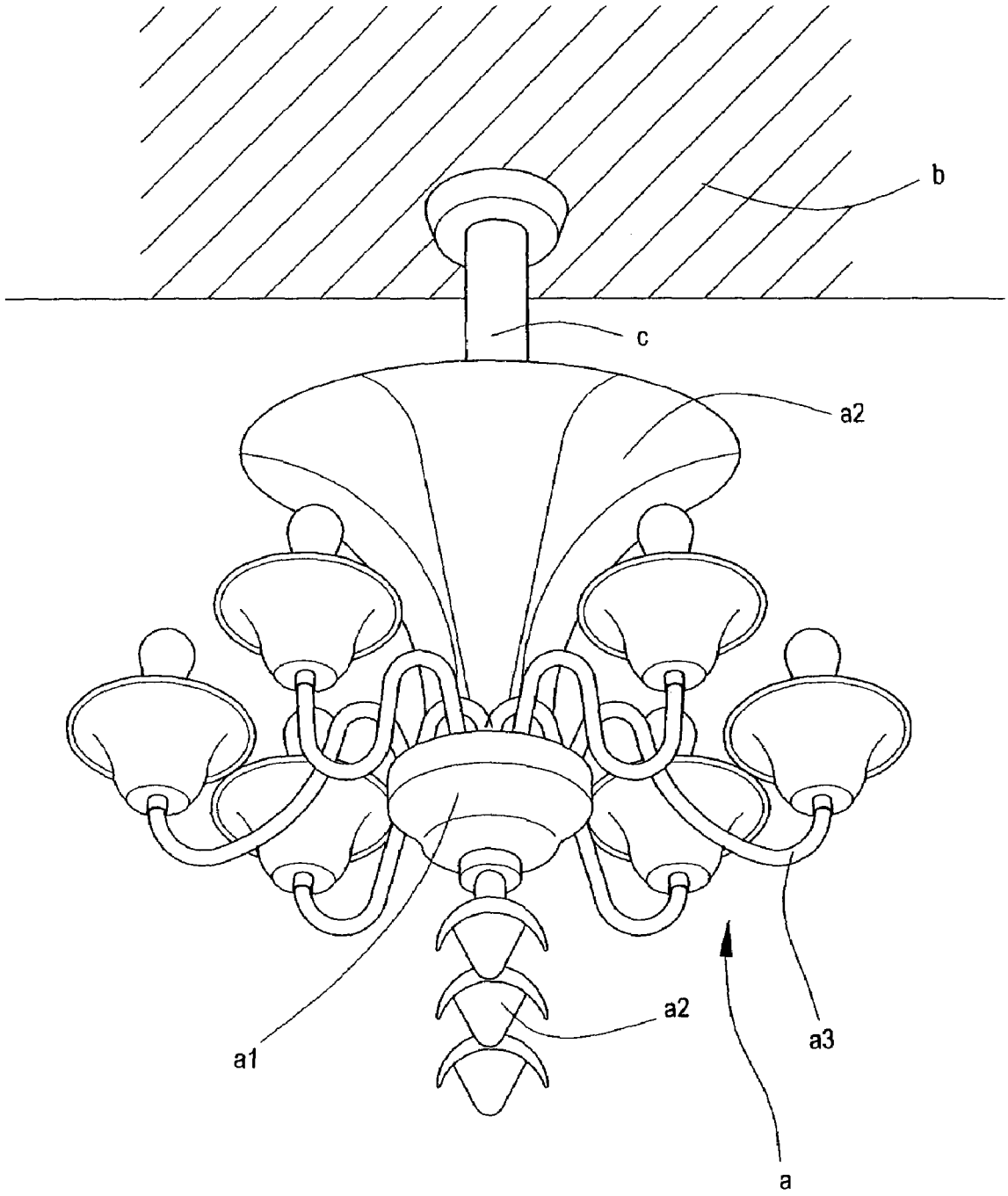
FIG . 1 PRIOR ART
FIG. 1 shows a structural elevational view of a conventional artistic lamp.
Figure 2:
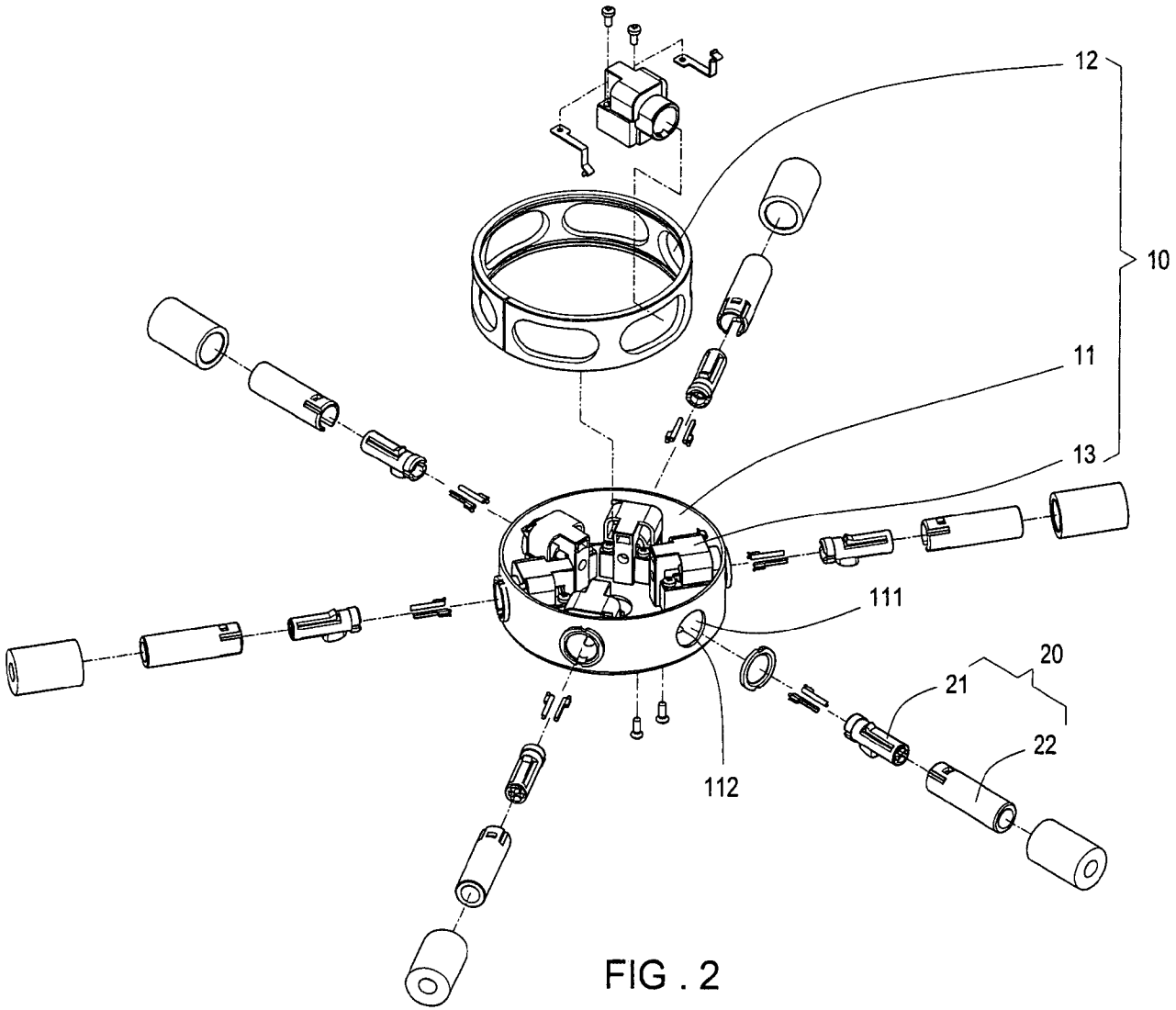
FIG. 2 shows an exploded elevational view according to the present invention.

Referring to FIG. 2, which shows a wiring box for artistic lamp of the present invention primarily constructed to embrace a lamp main body 10 and a plurality of plugs 20, wherein, the lamp main body 10 encompasses a housing 11, a conducting ring 12 and a plurality of conducting sockets 13. Each of the plugs 20 comprise a conducting sleeve 21 and a connecting sleeve 22, moreover, shape of a frontal section of each of the plugs 20 is so adapted to correspond to that of the conducting sockets 13 for plugging thereinto.

Figure 3:
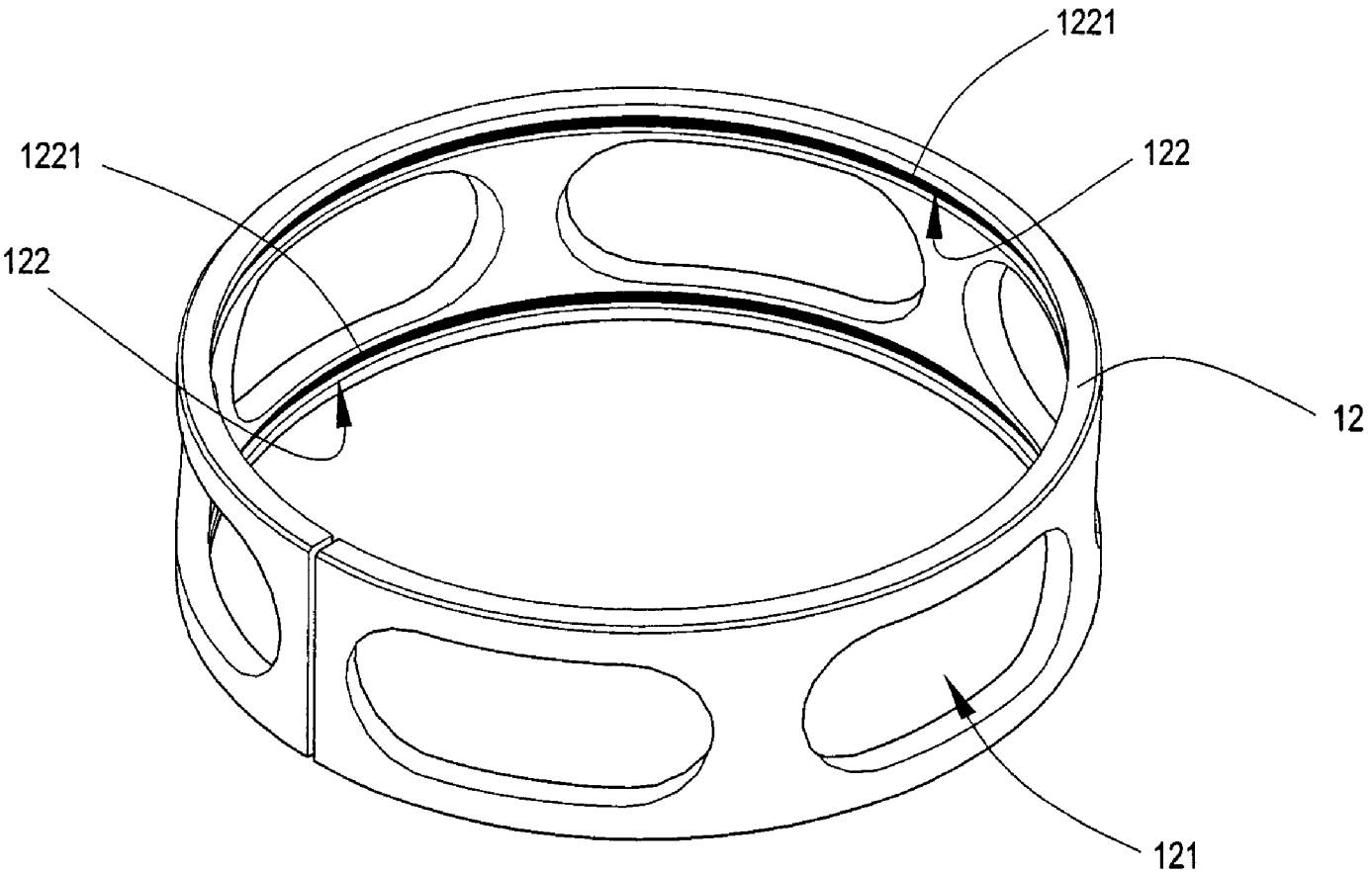
FIG. 3 shows a structural elevational view of a conducting ring according to the present invention.
Figure 4:
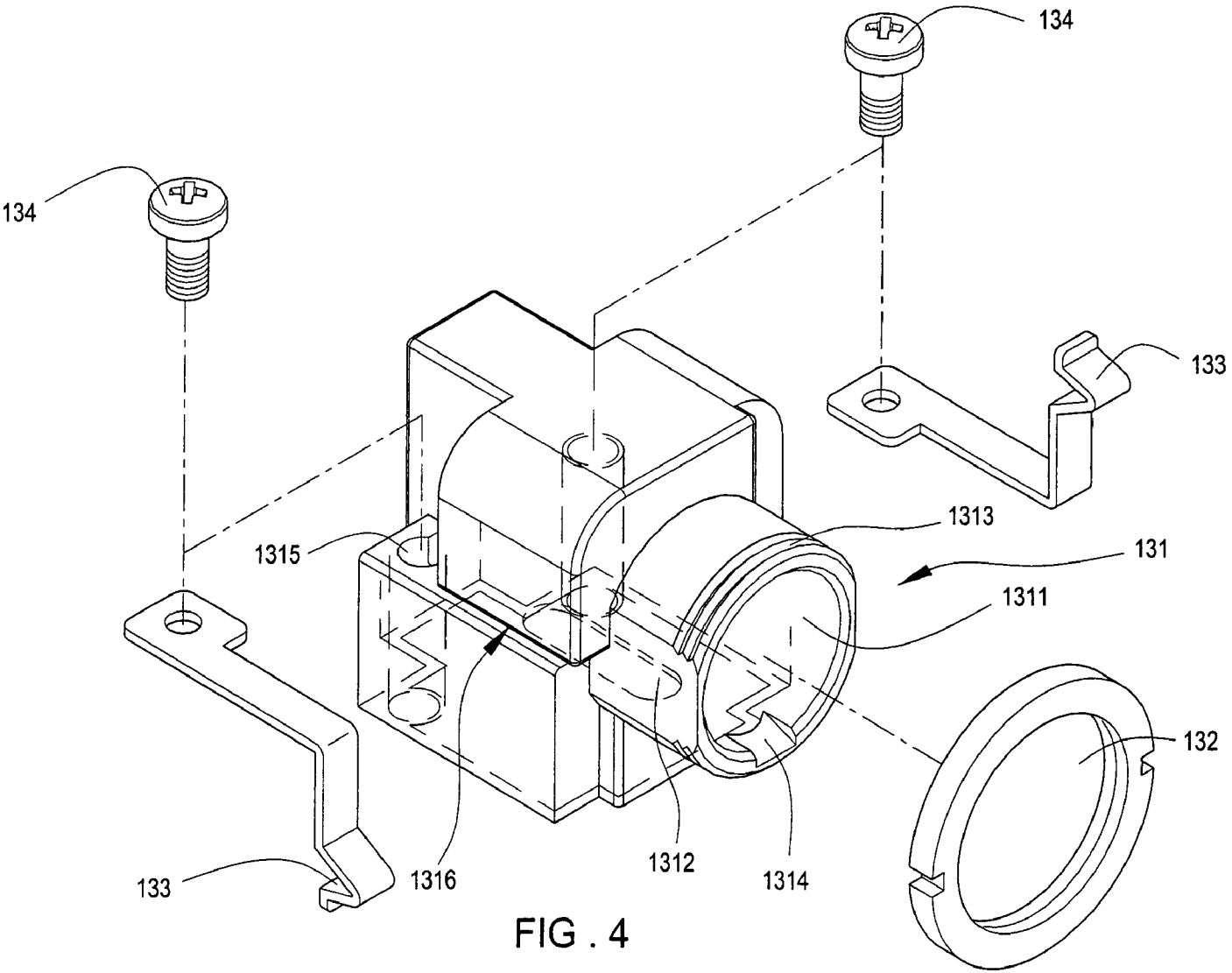
FIG. 4 shows a structural exploded elevational view of a conducting socket according to the present invention.
Figure 5A:
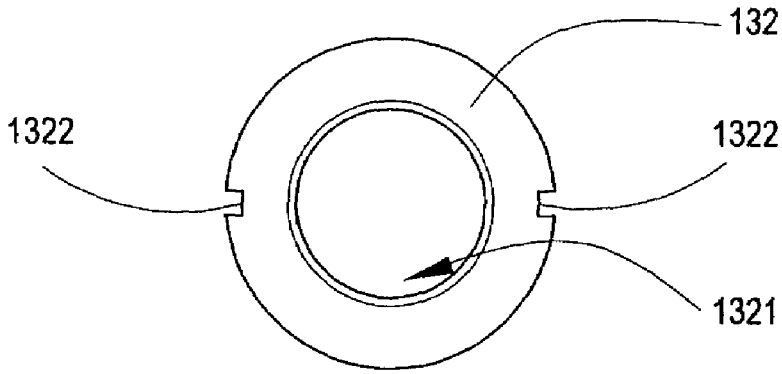
FIG. 5A shows a top view of a fixing piece according to the present invention.
Figure 5B:
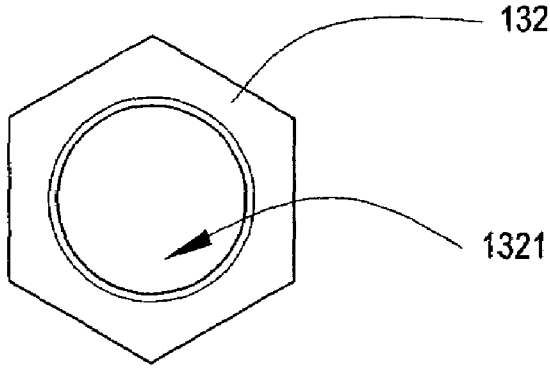
FIG. 5B shows a top view of another fixing piece according to the present invention.
Figure 5C:
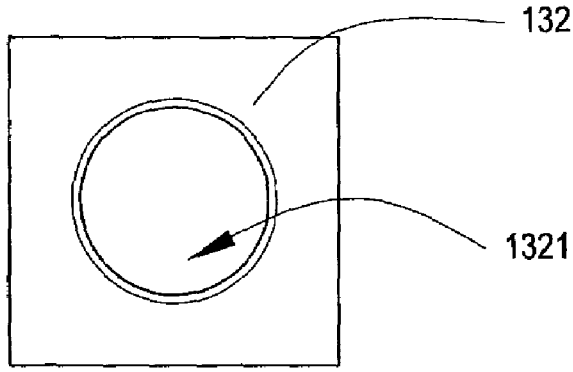
FIG. 5C shows a top view of yet another fixing piece according to the present invention.
Figure 6:
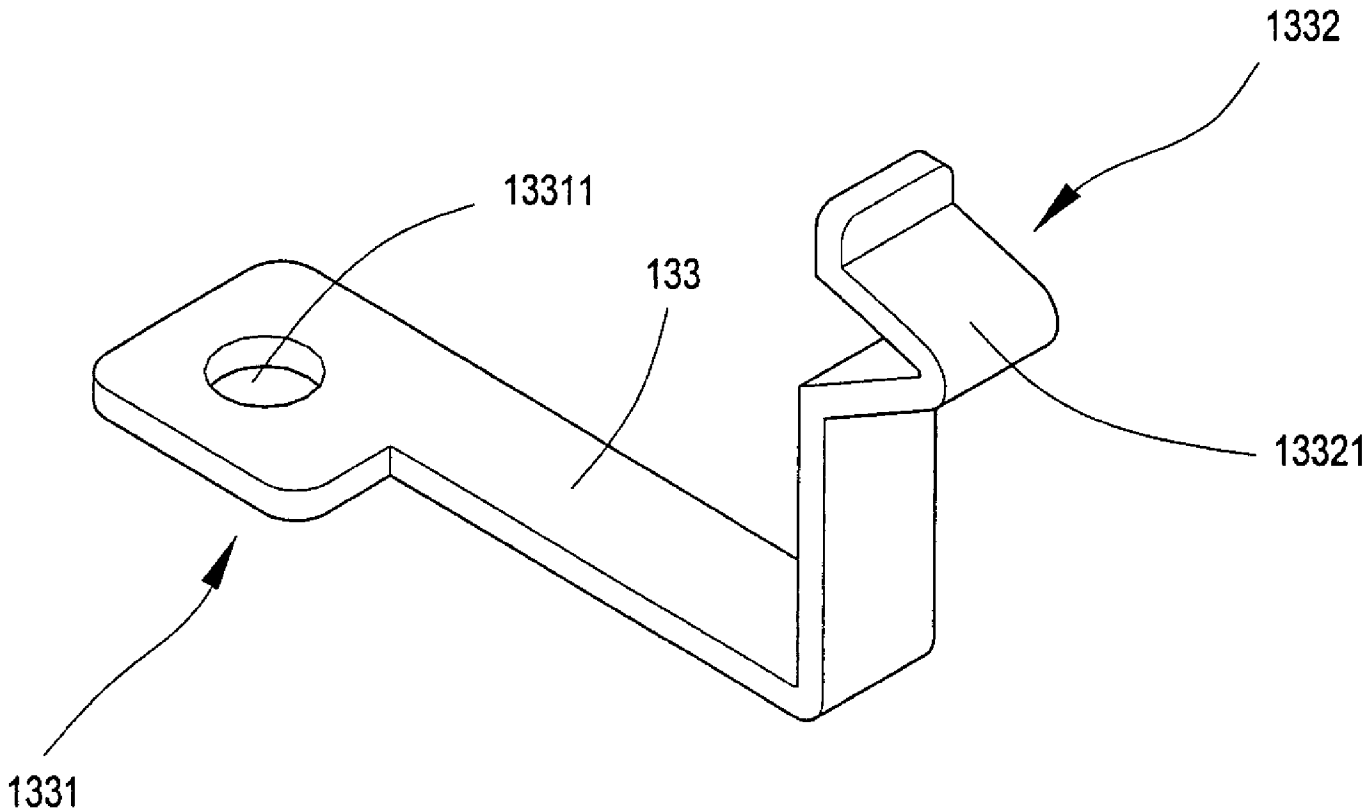
FIG. 6 shows a structural elevational view of a conducting copper strip according to the present invention.
Figure 7:
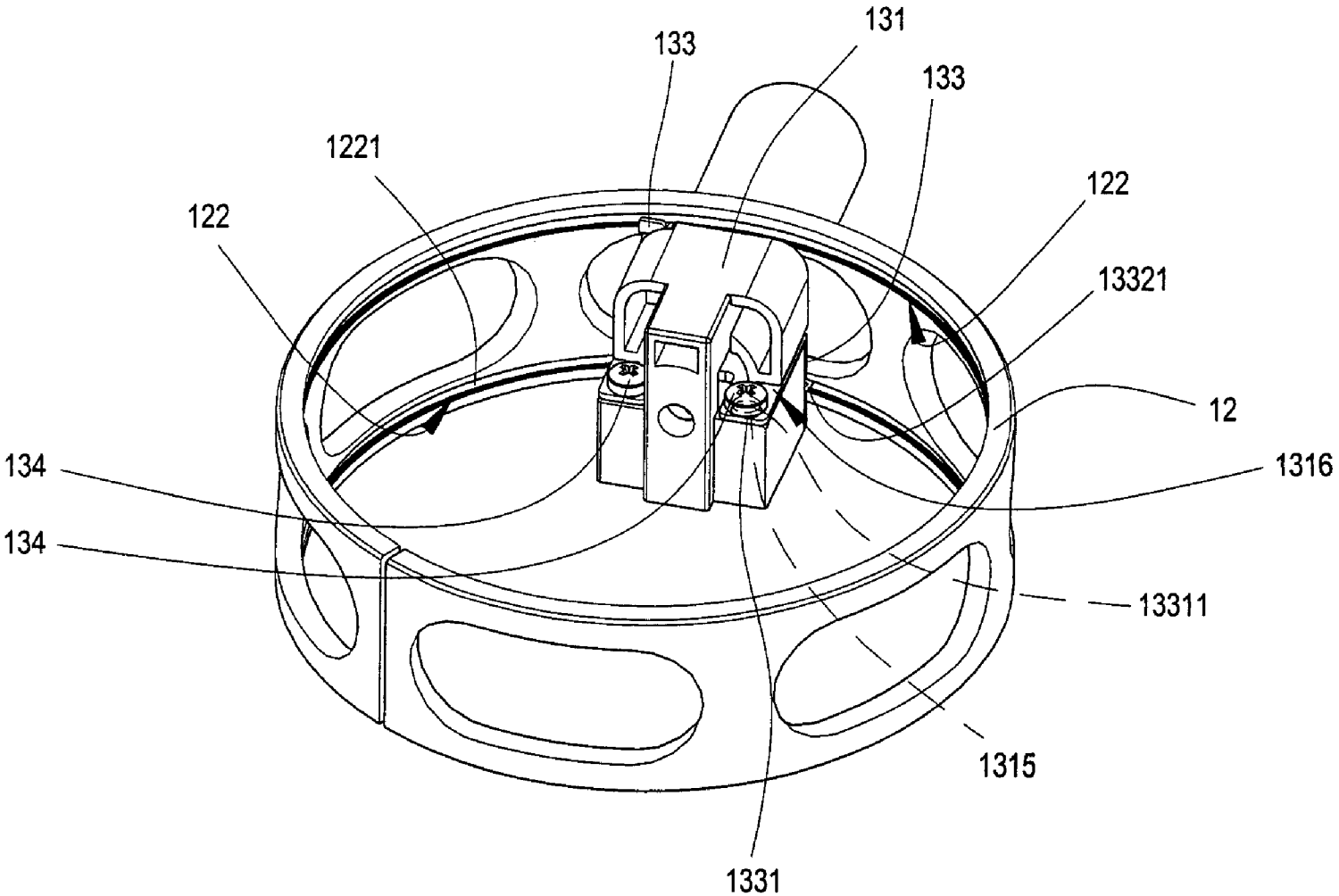
FIG. 7 shows an assembled elevational view of the conducting copper strips, the conducting socket and the conducting ring according to the present invention.

The lamp main body 10.is constructed from the housing 11, the conducting ring 12 and the plurality of conducting sockets 13, and external appearance of the housing 11 is such to assume a circular box form (shape of the housing 11 can also be adapted to assume a square box form, a triangular box form or other irregular geometrical shaped box). A plurality of circular apertures 111 having same dimensions are defined in a side wall of the housing 11. Release apertures 112 are defined in a base of the housing 11 so as to correspond with each of the conducting sockets 13. Referring to FIG. 3 depicting the conducting ring 12, and which is disposed within the housing 11, and moreover, a plurality of oval apertures 121 having same dimensions are defined in a side wall of the conducting ring 12. Annular grooves 122 are separately defined in an upper edge and a lower edge of an inner wall of the conducting ring 12. Furthermore, an inner surface of each of the annular grooves 122 is provided with a conducting metallic layer 1221. Referring to FIG. 4 depicting the conducting socket 13, and which is assembled to comprise a coupling seat 131, a fixing piece 132, two conducting copper strips 133 and screws 134, wherein a long through-hole 1311 and a fastening portion 1312 are defined interior of the coupling seat 131, moreover, a frontal end of the coupling seat 131 is provided with a screw thread 1313, and a lower portion of an inner side wall of the coupling seat 131 is provided with an inclined notch 1314. Left and right sides at a rear end of the coupling seat 131 are respectively provided with screw holes 1315 and a clamping slot 1316 for fixing the conducting copper strip 133 thereof. Referring to FIGS. 5A, 5B and 5C, which show screw holes 1321 defined in a center of variant shaped fixing pieces 132, wherein, from a front view, external appearance of the fixing pieces 132 assume a circular form (or a hexagonal form or a square form). Furthermore, notches 1322 are defined in opposite side edges of the circular fixing piece 132. Referring to FIG. 6 depicting the conducting copper strip 133, and which from a side view, external appearance of the conducting copper strip 133 assumes a L-shape, and is separated into a fixing end 1331 and a vertical end 1332. A circular aperture 13311 is defined in a rear end of the fixing end 1331. An end of the vertical end 1332 is outwardly bent so as to form a V-shaped contact point 13321. Referring to FIG. 7, the conducting copper strips 133 are separately configured within the clamping slots 316 of the coupling seat 131. Furthermore, the screws 134 pass through the circular apertures 13311 of the conducting copper strips 133, and thereafter are securely screwed into the screw holes 1315 of the coupling seat 131 thereof, thereby enabling the V-shaped contact points 13321 of the two lateral conducting copper strips 133 to protrude and face upwards and downwards respectively, thus allowing the V-shaped contact points 13321 to come in contact with the conducting metallic layer 1221 configured interior of the annular grooves 122 of the conducting ring 12. In addition, an inner edge of the fixing ends 1331 of the conducting copper strips 133 extends inwardly from two lateral openings at a rear end of the coupling seat 131.

Figure 8A:
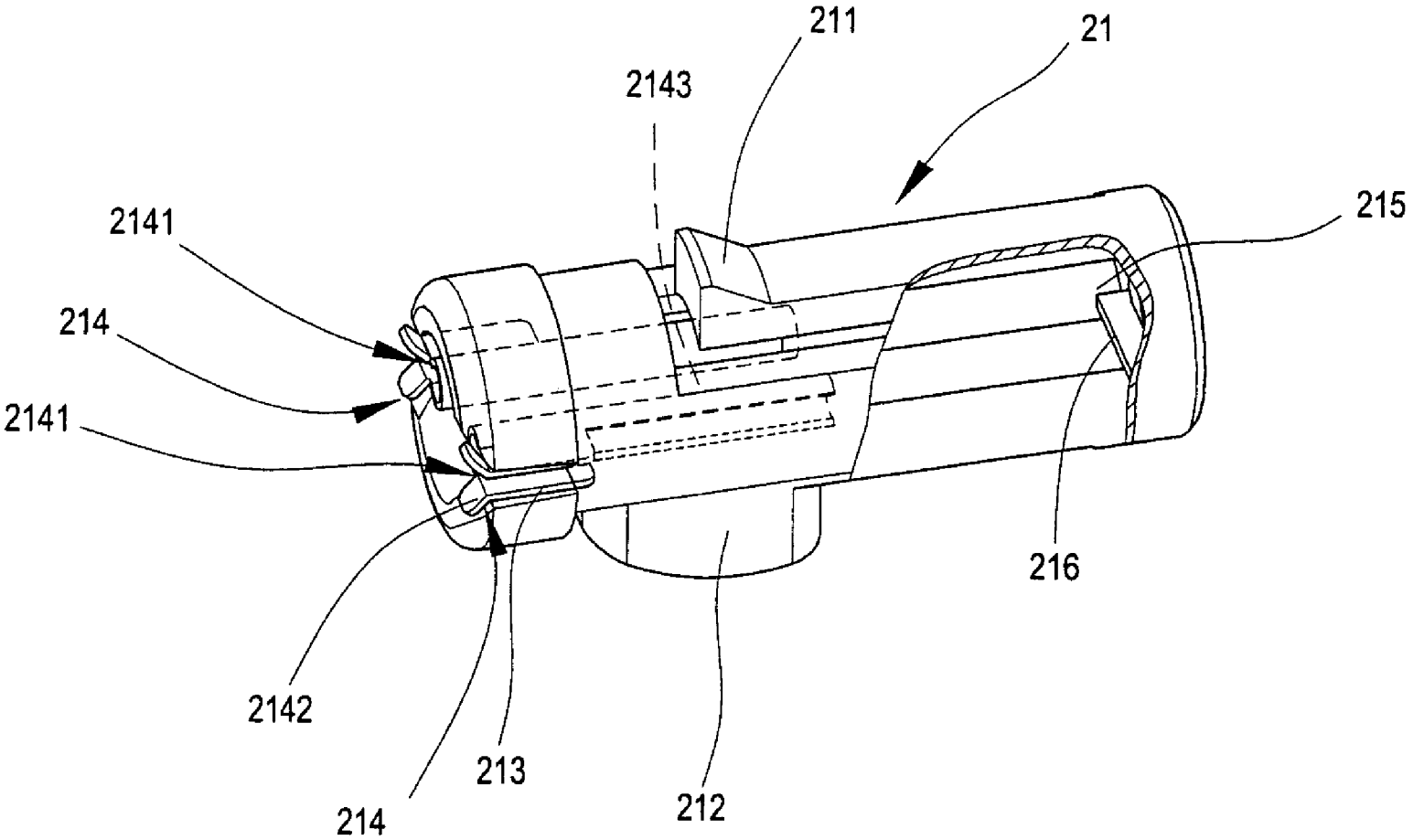
FIG. 8A shows a structural elevational view of a conducting sleeve according to the present invention.
Figure 8B:
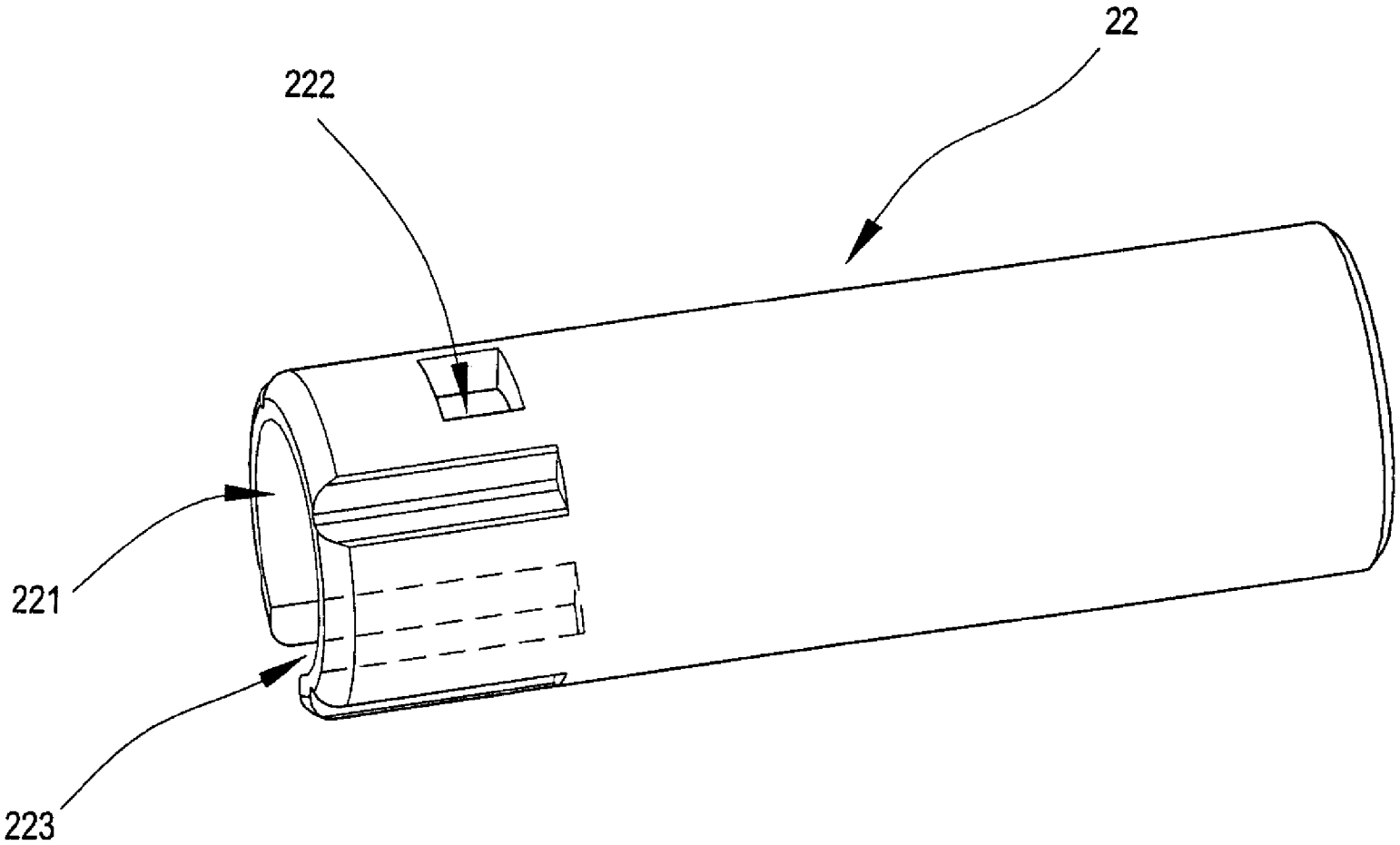
FIG. 8B shows a structural elevational view of a connecting sleeve according to the present invention.

Each of the plugs 20 is constructed to comprise the conducting sleeve 21 at a frontal section and the connecting sleeve 22 at a rear section. Referring to FIGS. 8A and 8B, clip fastening structures 211 and 212 are separately configured on upper and lower external side walls of the conducting sleeve 21 respectively, moreover, conducting clips 214 are separately configured within opening grooves 213 defined on left and right sides at a frontal end of the conducting sleeve 21. A frontal end of each of the conducting clips 214 is provided with an inverted U-shaped clip portion 2141, and which is further configured with a forwardly and outwardly bent guide portion 2142. A rear half of the conducting clips forms a semicircular flexing 2143, which is configured to fit within a circular groove 215 interior of the conducting sleeve 21. Left and right side walls at a rear end of the circular groove 215 are connectively reinforced by means of a connecting portion 216. The connecting sleeve 22 is manufactured so as to form a tubular form, wherein center of the connecting sleeve 22 is provided with a long through-hole 221. Dimensions of internal diameter of the connecting sleeve 22 are configured so as to correspond with external diameter of the conducting sleeve 21.

An upper side wall of the connecting sleeve 22 is provided with a fastening portion 222, and a lower side wall of the frontal end of the connecting sleeve 22*s* provided with an opening groove 223, shape and dimensions of which is such to correspond to shape and dimensions of the clip fastening structure 212 of a lower section of the conducting sleeve 21. Upon assembling the aforementioned connecting sleeve 21 and conducting sleeve 22, the clip fastening structure 211 of an upper section of the conducting sleeve 21 clip fastens to the corresponding fastening portion 222 of an upper section of the connecting sleeve 22, the clip fastening structure 212 of the lower section is disposed into the opening groove 223 of the connecting sleeve 22, thereby forming the plug 20 provided with the conducting clips 214 and the clip fastening structure 212 having fixing functionality. After plugging into the conducting socket 13, the clip fastening structure 212 of the lower section of the conducting sleeve 21 clip fastens into the corresponding fastening portion 1312 of the conducting socket 13, moreover, the conducting clip 214 on the two sides of the frontal end of the conducting sleeve 21 thus clip onto the conducting copper strips 133 of the conducting socket 13, thereby forming an electrical conductance thereat.

Figure 9A:
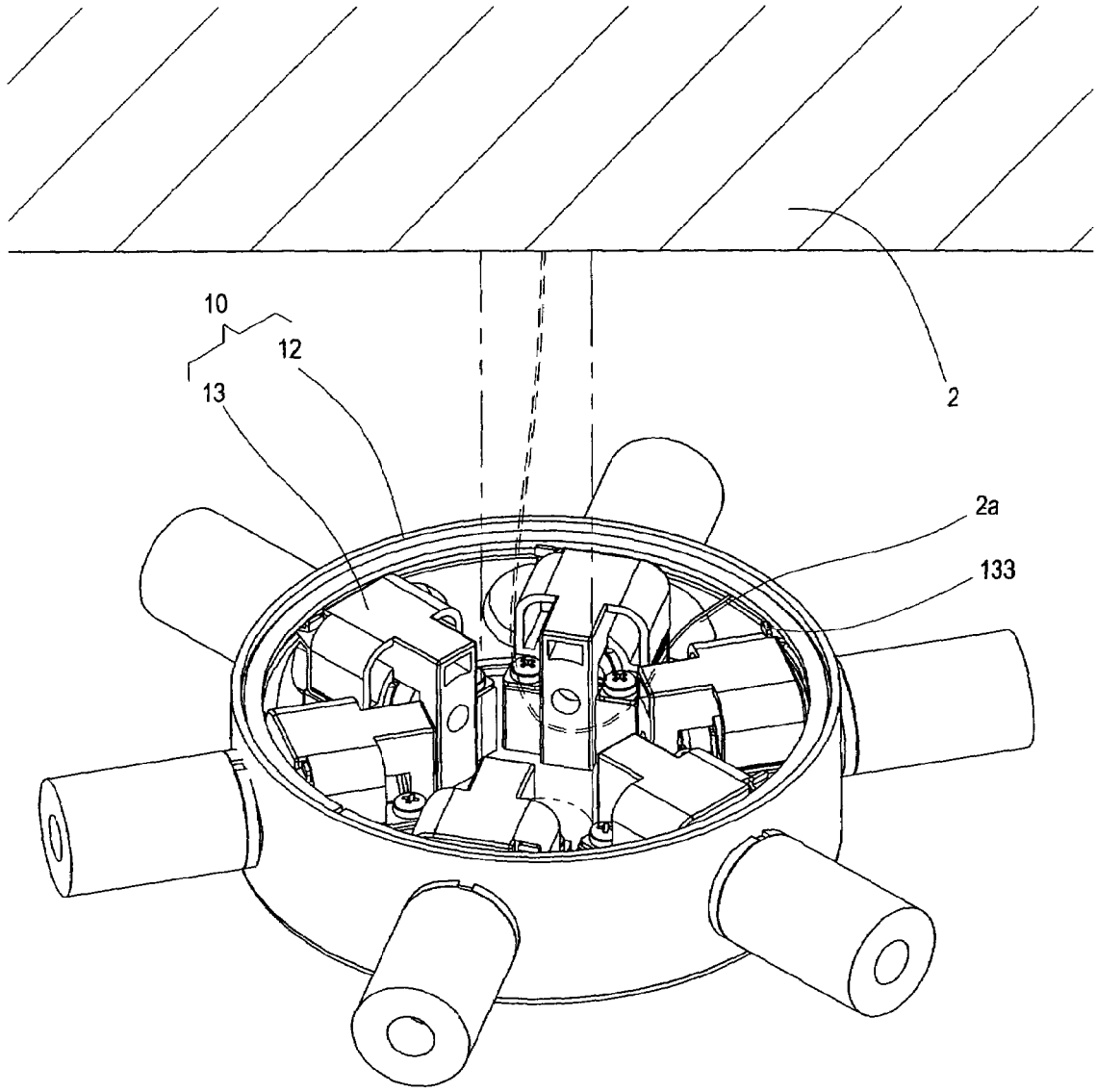
FIG. 9A shows a top cutaway view of a lamp main body according to the present invention.
Figure 9B:
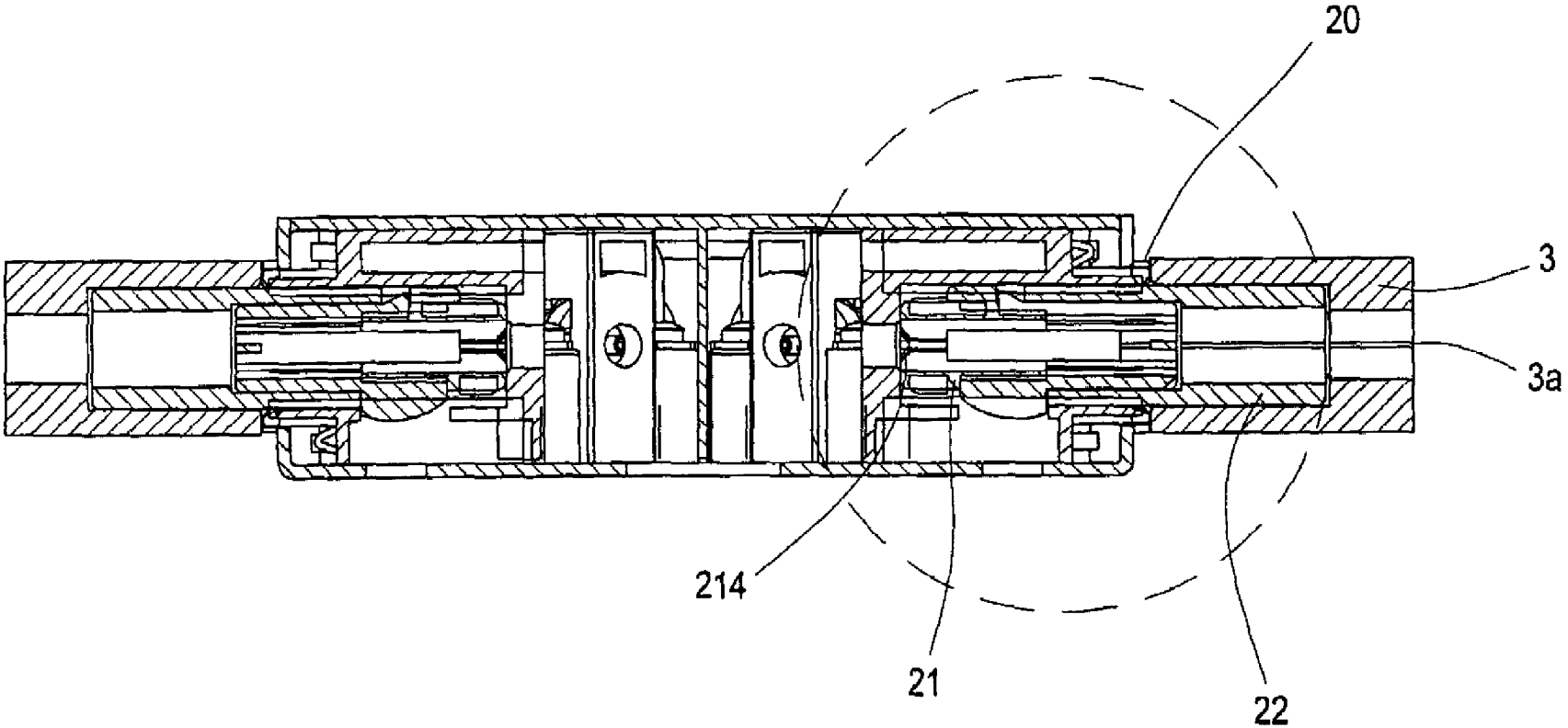
FIG. 9B shows a cross sectional view of an assemblage of a plug and a branch portion according to the present invention.
Figure 10A:
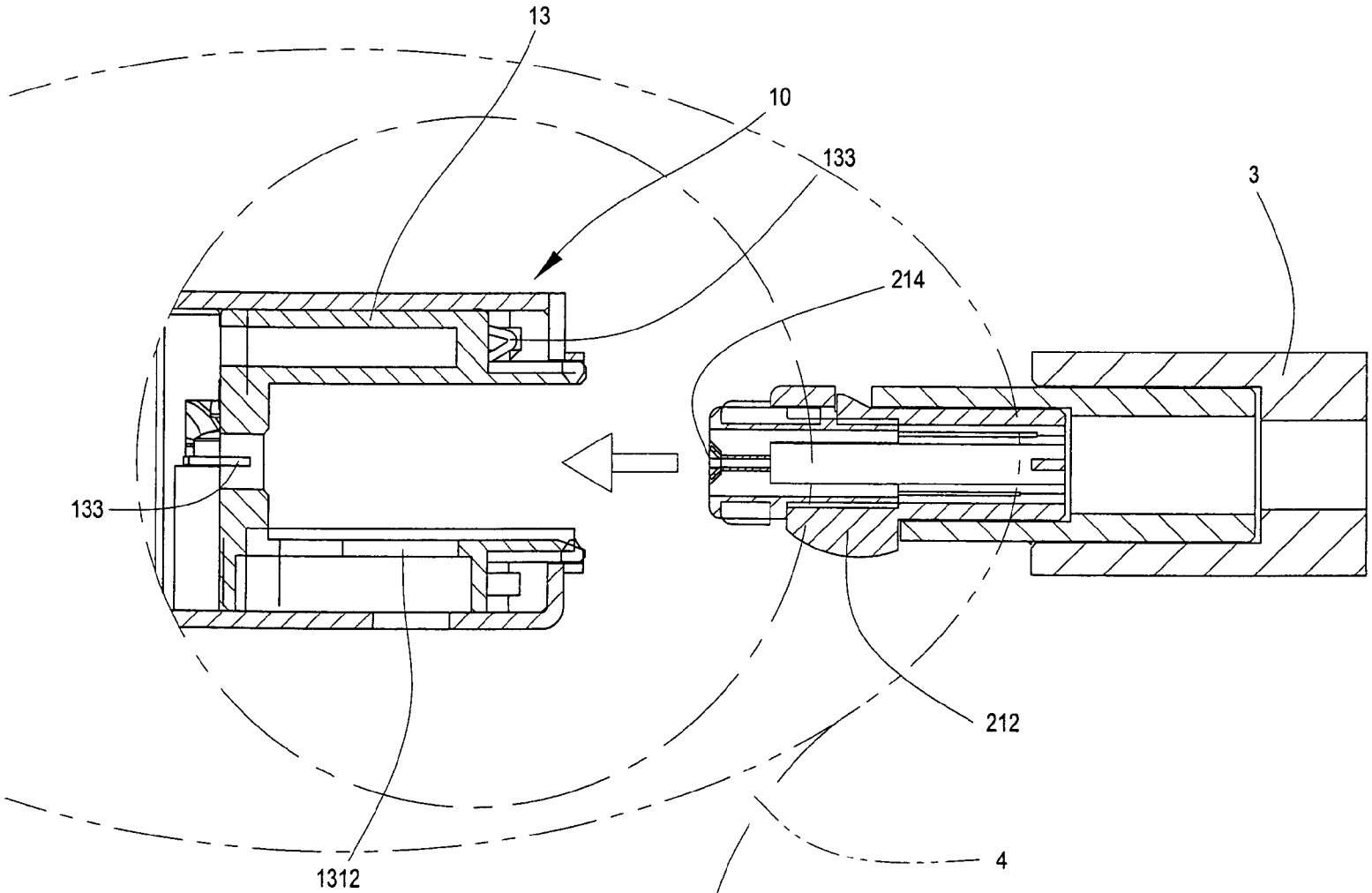
FIG. 10A shows a schematic view of the branch portion being connected to the lamp main body according to the present invention.
Figure 10B:
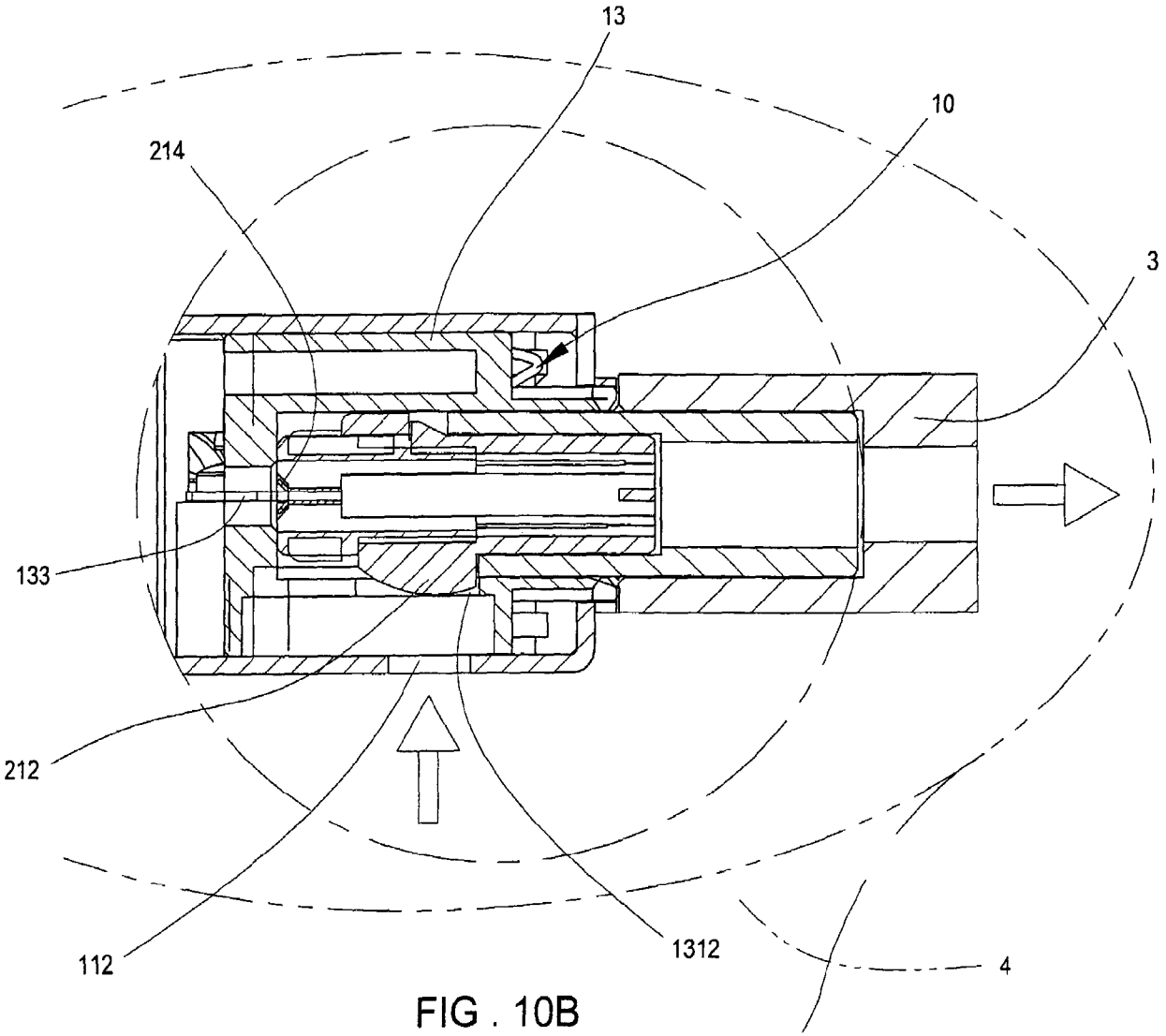
FIG. 10B shows a schematic view of the branch portion being disconnected from the lamp main body according to the present invention.

According to entire structural assemblage of aforementioned artistic lamp, and referring to FIG. 9A, first, the lamp main body 10 is securely fitted to the ceiling 2, and the conducting ring 12 of the interior of the lamp main body 10 is separately connected to a power supply, and the conducting copper strips 133 of the conducting sockets 13 are separately connected to the conducting ring 12, thereby enabling the conducting sockets 13 to realize an electrical conducting state. In addition, referring to FIG. 9B, the connecting sleeve 22 of each of the plugs 20 is directly fitted onto extremities of each of the branch portions of the artistic lamp, and a power supply connecting cable 3*a* of each of the light bulbs of the artistic lamp is connected to the connecting clips 214 of the conducting sleeve 21. Referring to FIGS. 10A and 10B, upon the lamp main body 10 being combined with the artistic lamp branch portions 3, the plugs 20 are directly plugged into the conducting sockets 13 of the lamp main body 10, thereby enabling the conducting clips 214 of the artistic lamp branch portions 3 to clip fasten onto the conducting copper strips 133 of the conducting sockets 13, and thereby realize the electrical conductance thereat, whereupon the clip fastening structure 212 of the lower section of the outer side wall of each of the plugs 20 securely clip fastens into the corresponding fastening portion 1312 of the lamp main body 10. The clip fastening structures 212 further effectuate detachment from the release apertures 112 defined in the base of the housing 11. Furthermore, ornaments 4 are fitted at appropriate positions of the lamp main body 10, and a split-system artistic lamp is thereby realized, which not only effectuates convenient installation or disassembling of the artistic lamp, while ensuring a secure fitting that will not fall apart from the ceiling, but also a configuration that allows for separate storage and packaging of structural components of the artistic lamp, thereby averting shortcoming of inconvenient storage resulting from dimensions of the artistic lamp being excessive after completing assemblage of the entire artistic lamp.

In conclusion, the wiring box for artistic lamp of the present invention utilizes a split-system configuration to embody the lamp main body 10 of the artistic lamp, the branch portions and the ornaments, moreover, when installing the lamp main body 10, the clip fastening structures 211 and 212 configured on each of the plugs 20 of the branch portions achieves objective of rapid installation and disassembling, while ensuring the artistic lamp will not fall apart from a secure fitting to the ceiling thereof. Such structural improvements effectuate enhancement in effectiveness of convenience when packaging the artistic lamp, and moreover, practicability and advancement of the present invention assuredly conforms to requirements for a new patent. Accordingly, the inventor of the present invention proposes an application for a patent herein.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A wiring box for artistic lamp comprising a lamp main body and a plurality of plugs, wherein, the lamp main body comprises a housing, a conducting ring and a plurality of conducting sockets, each of the plugs comprise a conducting sleeve and a connecting sleeve, moreover, shape of a frontal section of each of the plugs is so adapted to correspond to that of the conducting sockets for plugging thereinto; and characterized in that: the conducting ring is disposed within the housing, and annular grooves are separately defined in an upper edge and a lower edge of an inner wall of the conducting ring, moreover, an inner surface of each of the annular grooves is provided with a conducting metallic layer; the conducting sockets are appropriately positioned and disposed within the housing, and each of the conducting sockets comprise a coupling seat, a fixing piece, two conducting copper strips and screws, and the conducting copper strips are separately configured within clamping slots of the coupling seat, moreover, the screws screw down the conducting copper strips to the coupling seat by passing through circular apertures in the conducting copper strips and then into screw holes of the coupling seat, thereby enabling V-shaped contact points of the two lateral configured conducting copper strips to protrude and face upwards and downwards respectively, and thus allowing the V-shaped contact points to come in contact with the conducting metallic layer configured interior of the annular grooves of the conducting ring, in addition, an inner edge of a fixing end of each of the conducting copper strips extend inwardly from two lateral openings at a rear end of the coupling seat; a clip fastening structure configured on an upper section of the conducting sleeve clip fastens to a corresponding fastening portion of an upper section of the connecting sleeve, and a clip fastening structure configured on a lower section of the conducting sleeve inserts into an opening groove of the connecting sleeve, which thereby forms each of the plugs provided with conducting clips and the clip fastening structures having fixing functionality thereof, whereafter plugging the plugs into the conducting sockets, the clip fastening structure of the lower section of the conducting sleeve of each of the plugs clip fastens into a corresponding fastening portion of each of the conducting sockets, moreover, the conducting clip on the two sides of a frontal end of the conducting sleeve of each of the plugs thus clip onto the conducting copper strips of each of the conducting socket, thereby forming electrical conductance thereat.

2. The wiring box for artistic lamp according to claim 1, wherein external appearance of the housing is such to assume a circular box form, moreover, a plurality of circular apertures having same dimensions are defined in a side wall of the housing, and release apertures are defined in a base of the housing so as to correspond with each of the conducting sockets.

3. The wiring box for artistic lamp according to claim 1, wherein external appearance of the housing is such to assume a square box form, moreover, a plurality of circular apertures having same dimensions are defined in the side wall of the housing, and the release apertures are defined in the base of the housing so as to correspond with each of the conducting sockets.

4. The wiring box for artistic lamp according to claim 1, wherein external appearance of the housing is such to assume a triangular box form, moreover, a plurality of circular apertures having same dimensions are defined in the side wall of the housing, and the release apertures are defined in the base of the housing so as to correspond with each of the conducting sockets.

5. The wiring box for artistic lamp according to claim 1, wherein external appearance of the housing is such to assume other irregular geometrical shaped box form, moreover, a plurality of circular apertures having same dimensions are defined in the side wall of the housing, and the release apertures are defined in the base of the housing so as to correspond with each of the conducting sockets.

6. The wiring box for artistic lamp according to claim 1, wherein a plurality of oval apertures having same dimensions are defined in a side wall of the conducting ring.

7. The wiring box for artistic lamp according to claim 1, wherein a long through-hole and the fastening portion are defined interior of the coupling seat, and a frontal end of the coupling seat is provided with a screw thread, moreover, a lower portion of an inner side wall of the coupling seat is provided with an inclined notch, left and right sides at a rear end of the coupling seat are respectively provided with screw holes and a clamping slot for fixing the conducting copper strip thereof.

8. The wiring box for artistic lamp according to claim 1, wherein a screw hole is defined in a center of a fixing piece, and from a front view, external appearance of the fixing piece assumes a circular form, moreover, notches are defined in opposite side edges of the fixing piece.

9. The wiring box for artistic lamp according to claim 1, wherein the screw hole is defined in the center of the fixing piece, and from a front view, external appearance of the fixing piece assumes a hexagonal form.

10. The wiring box for artistic lamp according to claim 1, wherein the screw hole is defined in the center of the fixing piece, and from a front view, external appearance of the fixing piece assumes a square form.

11. The wiring box for artistic lamp according to claim 1, wherein, from a side view, external appearance of the conducting copper strips assume a L-shape, and is separated into a fixing end and a vertical end, a circular aperture is defined in a rear end of the fixing end, and an end of the vertical end is outwardly bent so as to form a V-shaped contact point.

12. The wiring box for artistic lamp according to claim 1, wherein the clip fastening structures are separately configured on upper and lower external side walls of the conducting sleeve respectively, moreover, conducting clips are separately configured within opening grooves defined on left and right sides at the frontal end of the conducting sleeve, a frontal end of each of the conducting clips is provided with an inverted U-shaped clip portion, and which is further configured with a forwardly and outwardly bent guide portion, a rear half of the conducting clips forms a semicircular flexing, and which is configured to fit within a circular groove defined interior of the conducting sleeve; left and right side walls at a rear end of the circular groove are connectively reinforced by means of a connecting portion.

13. The wiring box for artistic lamp according to claim 1, wherein the connecting sleeve is manufactured so as to form a tubular form, and center of the connecting sleeve is provided with a long through-hole, moreover, dimensions of internal diameter of the connecting sleeve is configured so as to correspond with external diameter of the conducting sleeve; an upper side wall of the connecting sleeve is provided with the fastening portion, and a lower side wall of a frontal end of the connecting sleeve s provided with the opening groove, shape and dimensions of which is such to correspond to shape and dimensions of the clip fastening structure of the lower section of the conducting sleeve.

* * * * *